US008978824B2

(12) United States Patent
Czechowski et al.

(10) Patent No.: US 8,978,824 B2
(45) Date of Patent: Mar. 17, 2015

(54) TURBOMACHINERY WITH INTEGRATED PUMP

(75) Inventors: Edward Stanley Czechowski, Orchard Park, NY (US); Michael Anthony Nuchereno, Amherst, NY (US)

(73) Assignee: Ingersoll-Rand Company, Davidson, NC (US)

( * ) Notice: Subject to any disclaimer, the term of this patent is extended or adjusted under 35 U.S.C. 154(b) by 487 days.

(21) Appl. No.: 13/009,396

(22) Filed: Jan. 19, 2011

(65) Prior Publication Data

US 2012/0183391 A1 Jul. 19, 2012

(51) Int. Cl.

| | |
|---|---|
| ***F16C 17/00*** | (2006.01) |
| ***F16C 21/00*** | (2006.01) |
| ***F16C 43/00*** | (2006.01) |
| ***F16H 57/04*** | (2010.01) |
| ***F01M 1/00*** | (2006.01) |
| ***F01M 9/06*** | (2006.01) |
| ***F01M 11/02*** | (2006.01) |
| ***F04D 13/12*** | (2006.01) |
| ***F01D 25/20*** | (2006.01) |

(52) U.S. Cl.

CPC ..... *F04D 13/12* (2013.01); *F01D 25/20* (2013.01)

USPC ..... 184/5; 184/6.12; 184/11.2

(58) Field of Classification Search

CPC ..... F01D 25/20; F04D 13/12

USPC ..... 184/5, 6.12, 31, 100

See application file for complete search history.

(56) References Cited

U.S. PATENT DOCUMENTS

| | | | | | |
|---|---|---|---|---|---|
| 1,869,776 | A | * | 8/1932 | Randolph et al. | 184/4 |
| 1,883,832 | A | * | 10/1932 | Sundstrand | 417/303 |
| 2,225,228 | A | * | 12/1940 | Neeson | 417/415 |
| 2,277,270 | A | * | 3/1942 | Schmitter et al. | 418/32 |
| 2,481,143 | A | * | 9/1949 | Muller | 418/102 |
| 2,634,686 | A | * | 4/1953 | Schmitter | 418/206.7 |
| 3,598,455 | A | * | 8/1971 | Schmitz | 384/101 |
| 4,355,542 | A | * | 10/1982 | Tsutsumi et al. | 74/467 |
| 4,714,405 | A | | 12/1987 | Schaefer et al. | |
| 5,189,929 | A | * | 3/1993 | Chory | 74/606 A |
| 5,243,822 | A | * | 9/1993 | Vismara | 60/489 |
| 6,221,130 | B1 | | 4/2001 | Kolodziej et al. | |
| 6,488,467 | B2 | | 12/2002 | Czechowski et al. | |
| 6,616,421 | B2 | | 9/2003 | Mruk et al. | |
| 6,679,689 | B2 | * | 1/2004 | Takahashi et al. | 418/9 |

(Continued)

FOREIGN PATENT DOCUMENTS

| | | | |
|---|---|---|---|
| CN | 2275652 | Y | 3/1998 |
| GB | 167581 | A | 8/1921 |

OTHER PUBLICATIONS

PCT Notification of Transmittal of the International Search Report and Written Opinion; Application No. PCT/US2012/021141; Dated May 7, 2012; 12 pages.

*Primary Examiner* — Henry Liu

(74) *Attorney, Agent, or Firm* — Krieg DeVault LLP

(57) ABSTRACT

The disclosed embodiments include self-lubricating oil feed systems that may include an integral bearing. The oil feed systems may include gear pumps suitable to minimize the axial profile of the oil feed systems. Additionally, the oil feed systems may be directly coupled to turbomachinery having a gear, and provide for mechanical support and lubrication of certain components of the turbomachinery. In certain embodiments, the oil feed systems enables the transfer of a lubrication fluid to the bearing during operations of the turbomachinery.

30 Claims, 5 Drawing Sheets

(56) References Cited

U.S. PATENT DOCUMENTS

| | | | | |
|---|---|---|---|---|
| 6,692,235 | B2 | 2/2004 | Kolodziej et al. | |
| 7,819,634 | B2 | 10/2010 | Kolodziej et al. | |
| 7,832,992 | B2 | 11/2010 | Kolodziej et al. | |
| 7,854,299 | B2 | 12/2010 | Czechowski et al. | |
| 2006/0008368 | A1 | 1/2006 | Czechowski et al. | |
| 2007/0006675 | A1* | 1/2007 | Marla et al. | 74/424 |
| 2007/0166158 | A1 | 7/2007 | Kabir et al. | |
| 2009/0014244 | A1 | 1/2009 | Cavarello et al. | |
| 2009/0155096 | A1 | 6/2009 | Czechowski et al. | |
| 2010/0098534 | A1 | 4/2010 | Small et al. | |
| 2011/0280749 | A1* | 11/2011 | Hahn | 417/410.1 |

* cited by examiner

TURBOMACHINERY WITH INTEGRATED PUMP

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Pumps enable the flow of a fluid through various mechanical systems, such as turbomachinery. Turbomachinery may include pumps, turbines, and compressors. The pump may enable lubrication, cooling and/or sealing of the turbomachinery, thus increasing the operational life and efficiency of the turbomachinery. For example, heat generated by the turbomachinery may be transferred to a fluid and then transferred to a cooling medium. Likewise, the fluid may lubricate various mechanical components of the turbomachinery, decreasing friction between the components. Unfortunately, the pump may take valuable space, increasing the footprint of the turbomachinery.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
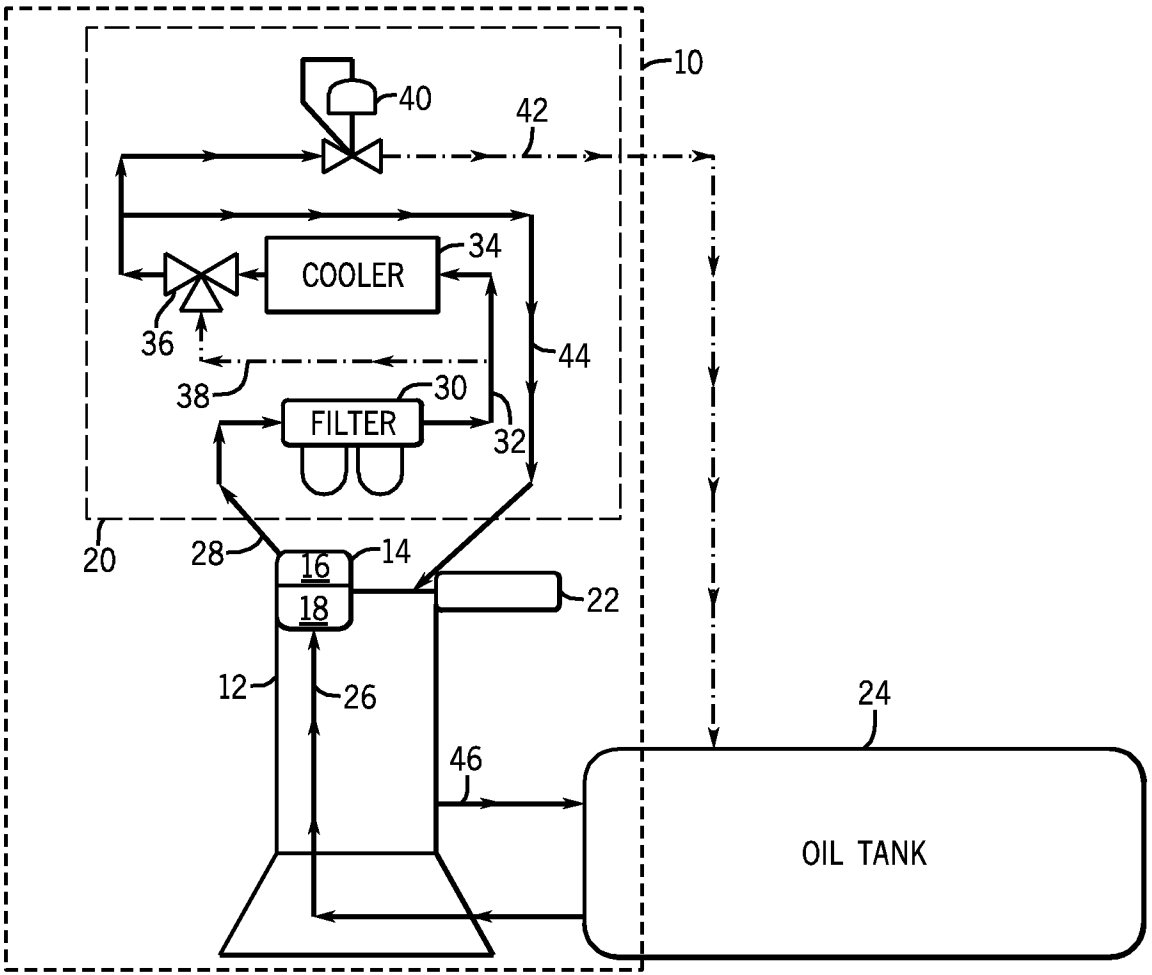
FIG. 1 is a schematic view of a turbomachinery including a bearing oil feed system, in accordance with one embodiment of the disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The disclosed embodiments include a bearing oil feed system including a gear pump, such as a crescent gear pump. The bearing oil feed system may also include a bearing support system, such as a sleeve bearing. In certain embodiments, the bearing oil feed system may be incorporated in turbomachinery, such as a compressor, a pump, or a turbine, and used to mechanically support as well as lubricate certain components of the turbomachinery. In one embodiment, the gear pump is a crescent gear pump that minimizes its axial length by incorporating two gears inside of a pump housing. In other embodiments, the gear pump may be a spur gear pump (e.g., pump having two side-by-side meshing spur gears), a helical gear pump (e.g., pump having meshing helical gears), or a gerotor pump (i.e., generated rotor pump), also suitable for minimizing the gear pump's axial length. Additionally, the bearing oil feed system, including the gear pump, may be recessed within the turbomachinery, further reducing an axial profile of the bearing oil feed system.

The integrated bearing system of the bearing oil feed system may support a gear included in a rotor of a turbomachinery, such as a compressor. For example, the gear may include a "bull" gear of the compressor suitable for driving one or more compressor scrolls. Additionally, the bearing oil feed system may supply a lubricant and/or coolant, such as oil, to various regions of the integrated bearing (e.g., sleeve bearing) as well as to other components of the turbomachinery. Indeed, the bearing oil feed system may use integral passages in the bearing and/or in the turbomachinery to deliver the lubrication and/or cooling fluid. Such integral passages include internal bores formed by drilling, casting, milling, and so forth. The integral passages may also be used to couple the gear pump and bearing system to an integral modular lubrication system. The integral modular lubrication system may further reduce the size and profile of the turbomachinery by integrating components such as a filter, heat exchanger, thermal regulator, and valves with the turbomachinery, further streamlining the turbomachinery size and geometric profile. Indeed, an improved lubrication system having enhanced suction life capabilities and reduced noise may be constructed using the embodiments disclosed herein.

With the foregoing in mind and turning to FIG. 1, the figure is a schematic view of an embodiment of a turbomachinery 10 including a rotor 12 and a bearing oil feed system 14. The bearing oil feed system 14 may further include a gear pump 16 and a bearing system 18 integrated within a turbomachinery component, such as a rotor 12. The figure is also illustrative of an embodiment of an integral modular lubrication system 20 that is suitable for lubricating components of the turbomachinery 10. Indeed, the integral modular lubrication system 20 may be integrated with the turbomachinery 10 and include internal or integral passages suitable for use as fluid conduits between components of the turbomachinery 10 and the integral modular lubrication system 20. The use of internal or integral passages may reduce or eliminate the use of external piping for the conduit lubrication fluid. The turbomachinery 10 may be any type of turbomachinery, such as a compressor, a pump or a turbine. The rotor 12 may be any type of rotating device that would benefit from lubrication. For example, the rotor 12 may be a rotor 12 that includes a "bull" gear of a centrifugal compressor, as described in more detail below with respect to FIG. 2.

During rotor operations, the rotor 12 may rotate about an axis, directly or indirectly driving a load such as a compressor scroll 22. It is to be understood that any mechanical load may be directly or indirectly coupled to the rotor 12 in addition to or alternative to the compressor scroll 22. For example electrical generators, other scrolls, vanes, blades, and so forth, may be coupled to the rotor 12. The rotor 12 is also coupled to the gear pump 16. Accordingly, the rotation of the rotor 12 may also drive the gear pump 16, creating a suction force or lift suitable for transferring a lubrication fluid from an oil tank 24 into the bearing oil feed system 14. In certain embodiments, the fluid may be transferred through integral passages 26. That is, passages or bores 26 internal to the turbomachinery 10 and/or rotor 12 may be used to direct the lubrication fluid into the bearing oil feed system 14. In this way, the use of external plumbing and/or feed lines is minimized or eliminated, resulting in the turbomachinery 10 having a more streamlined geometry or profile. The integral passages 26 may be formed by any suitable technique, such as drilling, casting, milling, and so forth.

The lubrication fluid may be used to lubricate any number of components of the turbomachinery 10, including the rotor 12. Indeed, the lubrication fluid may be further distributed to lubricate seal faces, other bearings, gears, and so forth. The gear pump 16 may also distribute the lubrication fluid to the bearing system 18 and/or to the integral modular lubrication system 20. Indeed, the bearing system 18 included in the bearing oil feed system 14 is a self-lubricating bearing system 18, in which an increase in the rotational motion of the rotor 12 results in additional lubrication of the bearing system 18 as described in more detail below.

The gear pump 16 may also direct the lubrication fluid into the integral modular lubrication system 20 for further processing, by using, for example, internal or integral passages 28. In other examples, external passages such as pipes or conduits may be used by the gear pump 16 to direct the lubrication fluid into the integral modular lubrication system 20. The integral modular lubrication system 20 may then filter the lubrication fluid by using a filter or strainer 30 suitable for removing particulate matter or otherwise for cleaning the lubrication fluid. The lubrication fluid may then be directed via internal passages 32, for example, into a heat exchanger 34 (e.g., cooler) suitable for cooling the lubrication fluid. More specifically, the heat exchanger 34 may cool the lubrication fluid by directing the lubrication fluid through a cooling medium, such as a gas or a liquid. Heat from the lubrication fluid may then transfer to the cooling medium, thereby reducing the temperature of the lubrication fluid.

In certain embodiments, a thermal regulator 36 may be included in the integral modular lubrication system 20. The thermal regulator 36 enables a more constant operating temperature for the lubrication fluid, for example, by using an integral passage 38 to bypass the heat exchanger 34 so as to maintain a more uniform operating temperature. For example, if the lubrication fluid is below a certain temperature, then no cooling may be needed. Accordingly, the integral passage 38 may be used to bypass the heat exchanger 34. Additionally, a pressure relief valve 40 may be used to maintain lubrication fluid pressure within a certain range. For example, should a pressure of the lubrication fluid exceed a certain limit, the pressure relief valve 40 may redirect a portion or all of the lubrication fluid flow into the oil tank 24 by using an integral passage 42, thus relieving the pressure. Otherwise, the lubrication fluid may be directed to flow into the turbomachinery 10 and the rotor 12 through integral passages 44. An integral passage 46 may then be used to transfer the lubrication fluid into the oil tank 24 for further reuse. By employing a bearing oil feed system 14 and an integral modular lubrication system 20, the turbomachinery 10 may include enhanced lubrication capabilities while also minimizing size, axial length, and reducing or eliminating the use of external pipes or conduits.

Figure 2:
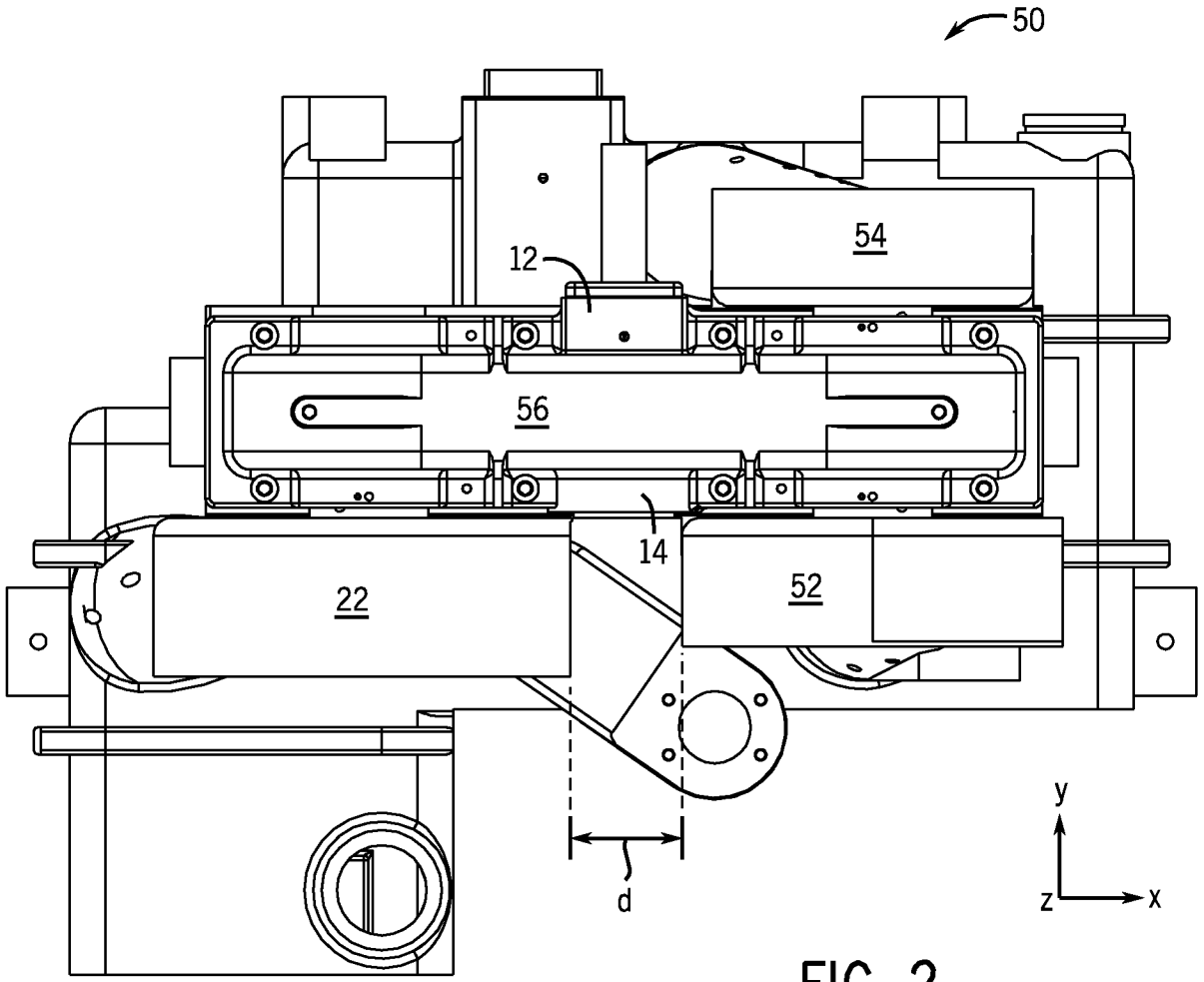
FIG. 2 is a perspective top view of a compressor including the bearing oil feed system of FIG. 1, in accordance with one embodiment of the disclosure.

FIG. 2 is a perspective top view of an embodiment of a turbomachinery 10 (e.g., centrifugal compressor 50), including the bearing oil feed system 14 directly coupled to the rotor 12. In the depicted embodiment, three scrolls, 22, 52, and 54 are connected to the rotor 12 through a "bull" gear 56. The scrolls 22, 52, and 54 are suitable to compress or pressurize a fluid, and may be used in stages. For example, the scrolls 22, 52, and 54 may be used to force a refrigerant fluid outwardly, exerting a centrifugal force on the fluid. In one example, scroll 22 may be used as a first stage scroll, scroll 52 may be used as a second stage scroll, and scroll 54 may be used as a third stage scroll. The fluid may be compressed at a higher ratio at each successive stage, resulting in an efficient, high-ratio compression of the fluid. Larger diameter scrolls allow for a higher intake of fluid and a corresponding increase in compressor production. By axially reducing the length of the bearing oil feed system 14, the diameters of the scrolls 22 and 52 may be enlarged. Indeed, an axially short bearing oil feed system 14 may enable the reduction or elimination of a distance d separating the two scrolls 22 and 52. In one embodiment, the reduction of the axial protrusion of the bearing oil feed system 14 enables the two scrolls 22 and 52 to be approximately adjacent to each other, with no separation distance d. Accordingly, the bearing oil feed system 14 may include pumps having minimal axial lengths, such as gear pumps, and may be recessed into the "bull" gear 56 so as to enable the reduction or elimination of the separation distance d. Additionally, the bearing oil feed system 14 may be directly coupled to the gear 56 of the rotor 12, thus providing for a self-lubricating bearing oil feed system 14 that may also pump lubricant fluid to other components of the compressor 50.

Figure 3:
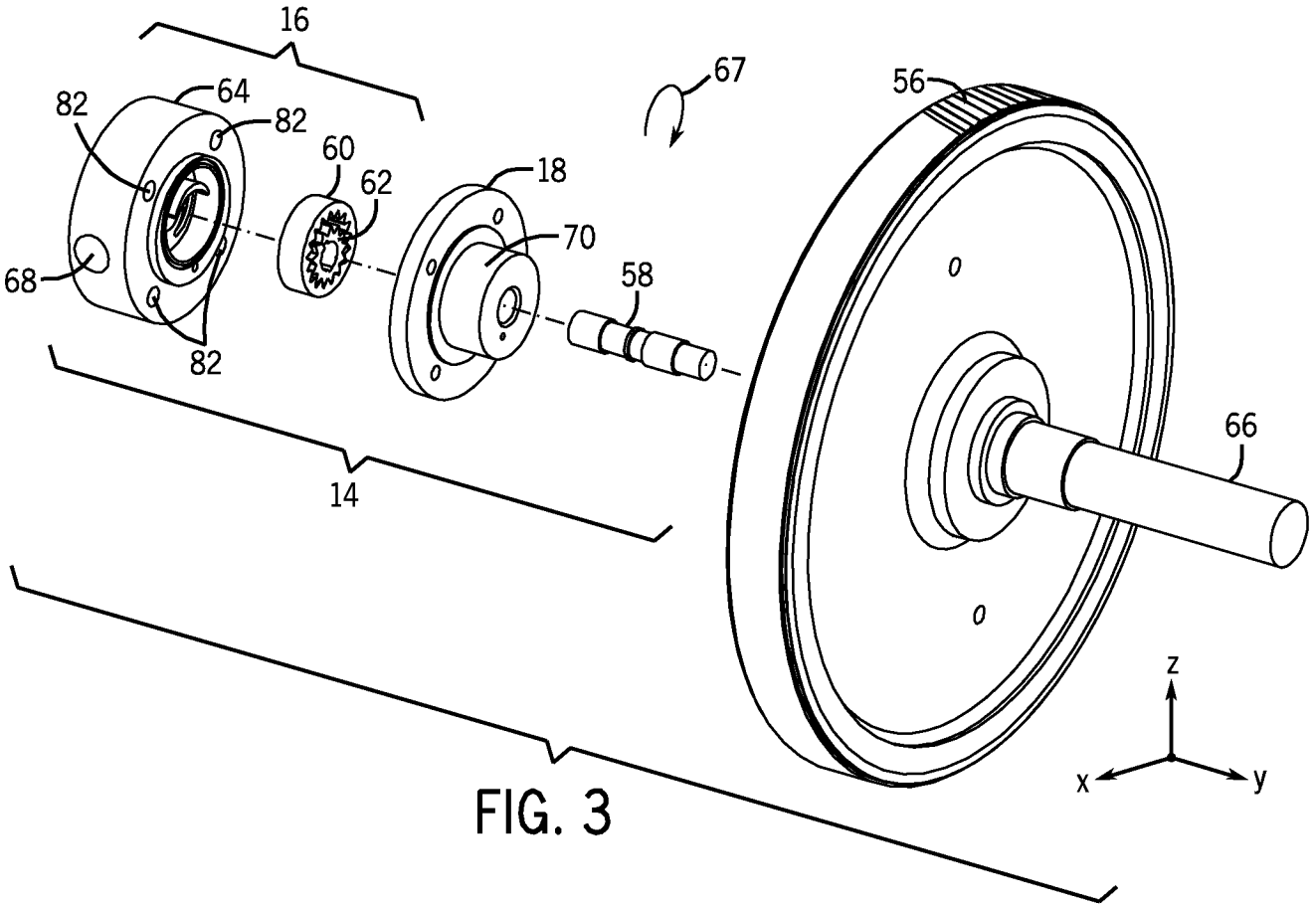
FIG. 3 is an exploded perspective side-view of components of a bearing oil feed system and a gear, in accordance with one embodiment of the disclosure.

FIG. 3 is an exploded side view of embodiments of the "bull" gear 56 and the bearing oil feed system 14 of FIG. 2. In the depicted embodiment, a shaft 58 included in the bearing oil feed system 14 and may be used to directly couple the bearing oil feed system 14 to the gear 56. More specifically, the shaft 58 may axially traverse the bearing system 18, and couple with a set of gears 60 and 62 of the gear pump 16. The gears 60 and 62 may be disposed inside of a gear housing 64, which may be securely connected to the bearing system 18 by using fasteners such as threaded bolts. The shaft 58 of the bearing oil feed system 14 may then be coupled to a shaft 66 of the "bull" gear 56. The direct coupling of the shaft 66 to the "bull" gear 56 enables the gear pump 16 to pump whenever the "bull" gear rotates, as described below.

As the compressor 50 rotates the gear 56 around an axis, such as the Y-axis, the shaft 58 coupled to the gear 56 also rotates about the same axis. The bearing system 18 and housing 64 remain approximately stationary, enabling the gear 56 to rotate axially with respect to the bearing system 18 and the housing 64. However, since the shaft 58 is coupled to the gears 60 and 62, the gears 60 and 62 rotate with respect to the housing 64. The rotating gears 60 and 62 create a suction lift suitable for transferring lubrication fluid from the oil tank 24 (shown in FIG. 1) into the housing 64 through an inlet port 68. In some embodiments, the lubrication fluid may be further directed into certain regions of the bearing system 18, such as an outer cylinder wall 70 of the bearing system 18, as described below with respect to FIGS. 4 and 5. In these embodiments, further rotation of the gear 56 will cause additional transfer of the lubrication fluid into the bearing wall 70. Indeed, the self-lubrication bearing system 18 may transfer lubrication fluid based on the rotational motion of the gear 56.

Figure 4:
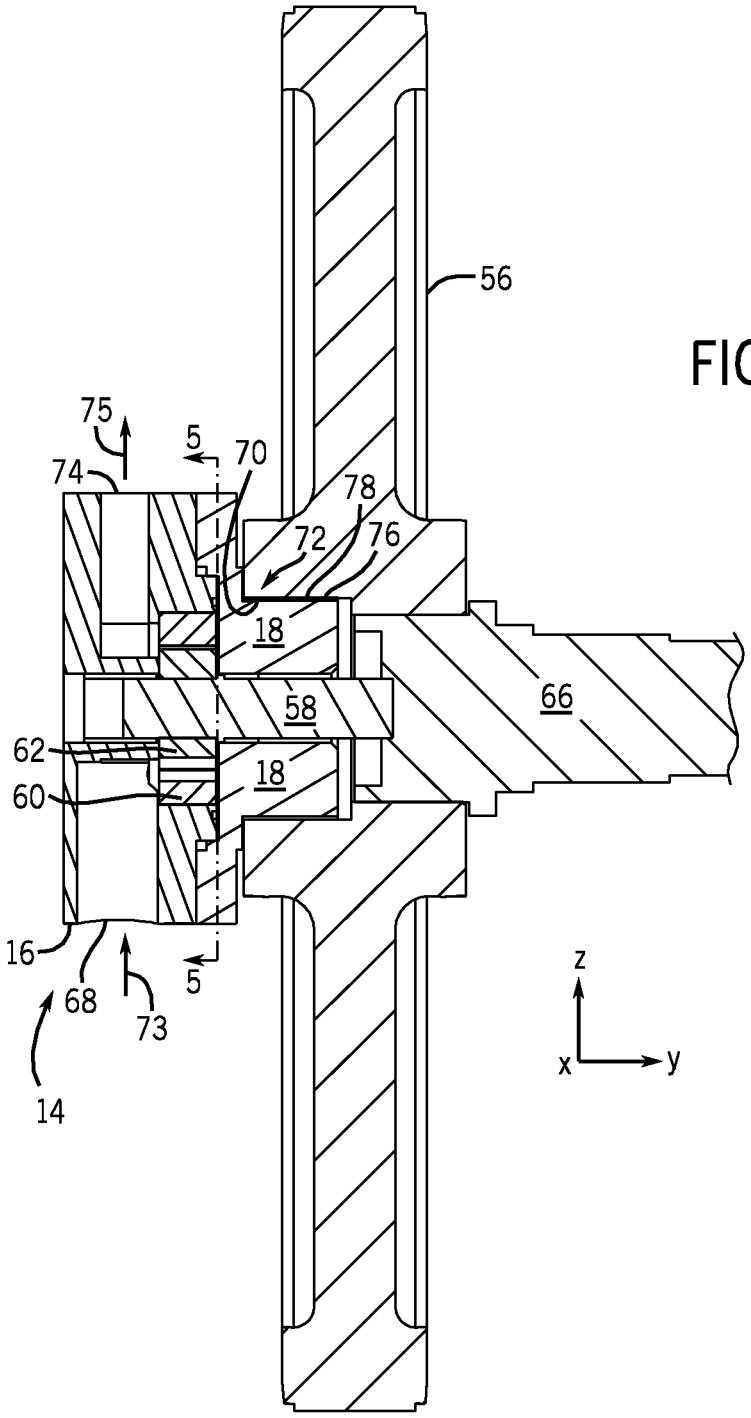
FIG. 4 is a cross-sectional side-view of the bearing oil feed system and gear of FIG. 3.

FIG. 4 is a cross-sectional view of the bearing oil feed system 14 recessed into the gear 56 and directly coupled to the gear 56 by using the shaft 58. As mentioned above, the bearing system 18 of the bearing oil feed system 14 may be used as a main bearing (e.g., sleeve bearing) suitable for enabling a mechanical support of the gear 56. Accordingly, an outer diameter of the cylinder wall 70 of the bearing system 18 may be approximately equal to an inner diameter of an inner chamber 72 of the gear 56. The bearing system 18 may then be recessed into the chamber 72, with the shaft 58 used to securely couple the bearing system 18 (and attached gear pump 16) to the shaft 66. The two shafts 58 and 56 may then mechanically support the gear 56 and enable the rotation of the gear 56 about an axis 67, such as the depicted Y-axis.

In the illustrated embodiment, rotation 67 of the gear 56 about the Y-axis results in an equivalent rotation 67 of the shaft 58. Accordingly, the gears 60 and 62 connected to the shaft 58 will also rotate. The rotation of the gears 60 and 62 may create a suction effect or lift. More specifically, the rotation of the gears 60 and 62 may create an expanding volume on an inlet port 68, which in turn creates a vacuum suitable for suctioning a flow 73 of lubrication fluid into the gear pump 16. The lubricant fluid may then be contained or trapped inside internal voids such as a void defined by teeth of the gears 60 and 62 as described in more detail below with respect to FIG. 5. Further rotational motion of the gears 60 and 62 may result in the lubrication fluid being displaced into an outlet port 74, resulting in an outwardly flow 75. In certain embodiments, the outlet port 74 may be connected to the integral modular lubrication system 20 (shown in FIG. 1), as well as to other components of the turbomachinery 10. Accordingly, the fluid flow 75 may be used by the integral modular lubrication system 20 and/or other turbomachinery 10 components for lubrication and cooling.

As illustrated, an integral passage 76 may be used to direct lubrication fluid to the integral modular lubrication system 20 and/or other components of the turbomachinery 10. Indeed, the integral passage 76 may direct lubrication fluid through the inside of the gear pump 16 and bearing system 18 for further use by the turbomachinery 10, eliminating the need for external conduits. Additionally, an integral passage 78 may transfer lubrication fluid from the integral passage 76 into the cylindrical wall 70 of the bearing system 18. By enabling a flow of lubrication fluid into the integral passage 78, an interface between the cylindrical wall 70 of the bearing system 18 and the inner chamber 72 of the gear 56 may be kept suitably lubricated. It is to be understood that a variety of gear pumps 16 may be used for transferring lubricant in the bearing oil feed system 14, such as a spur gear pump, a helical gear pump, a gerotor pump, or a crescent gear pump, which is described in more detail with respect to FIG. 5. For example, in a spur gear pump, two spur or star gears may be positioned side-by-side, with the two gears intermeshing with one another. In a helical gear pump, the two intermeshing gears may include a helical twist enabling a smoother flow of fluid. In a gerotor pump, a trochoidal inner rotor may be placed internal to an outer rotor having circular arcs.

Figure 5:
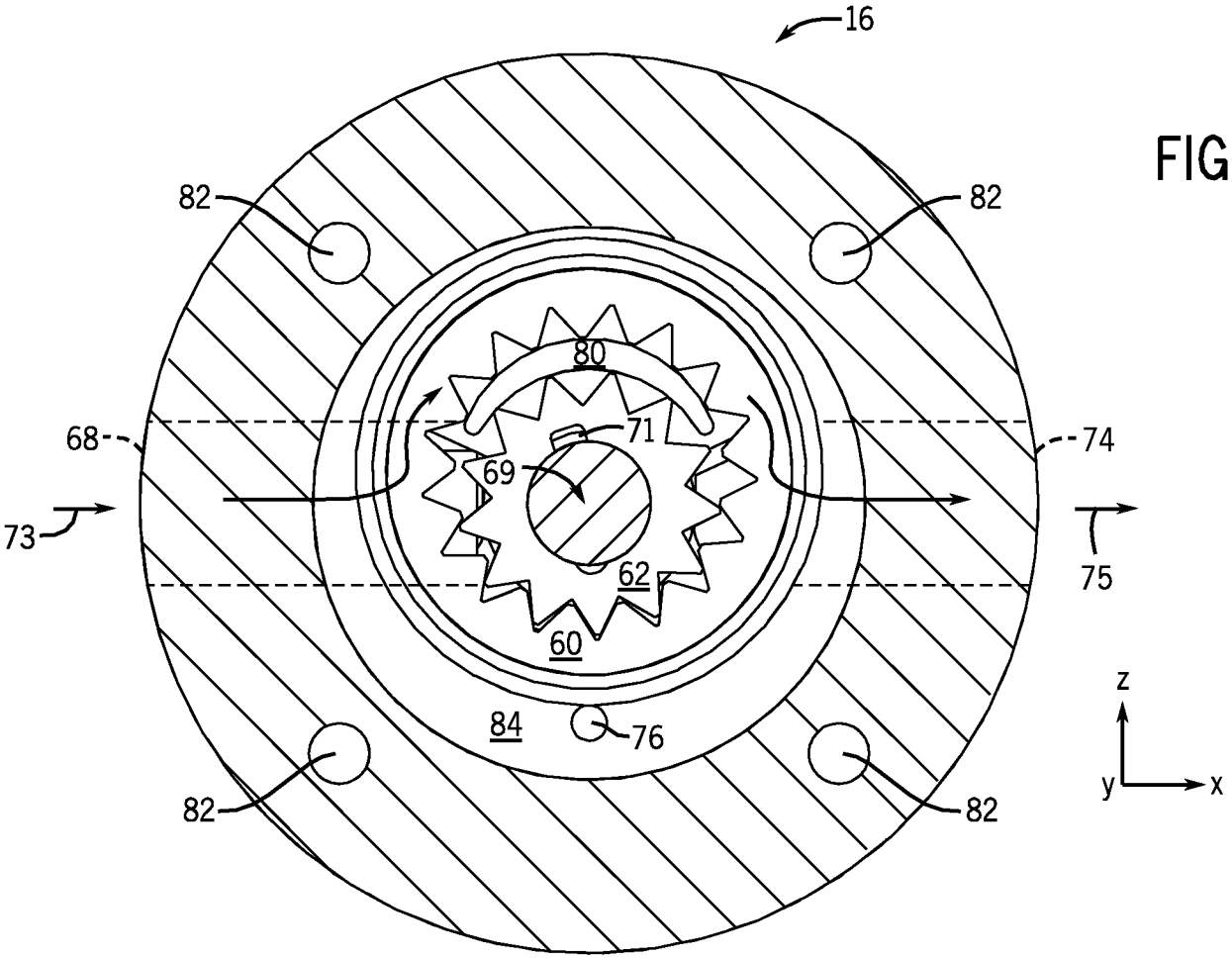
FIG. 5 is a cross-sectional top view of a crescent gear pump.

FIG. 5 is a cross-sectional top view of an embodiment of the gear pump 16 including a crescent 80, and the gears 60 and 62. As depicted, the pump 16 includes multiple openings 82 suitable for attaching the pump 16 to the bearing system 18 (shown in FIG. 4), e.g., with fasteners such as bolts. Also depicted in this embodiment is the flow 73 of lubrication fluid entering the gear pump 16 through the inlet port 68. Such a flow 73 may be caused by the rotation of the gears 60 and 62 which in turn may be caused by a rotation of the shaft 58. The shaft 58 may couple to gear 62 by extending into bore 69 of the gear 62, and then a key insert of the shaft 58 may interlock with key slots 71 to secure the shaft 58. The rotation of the gears 60 and 62 may cause the lubrication fluid flow 73 to enter the pump 16 and into voids between teeth of the gears 60 and 62. As the flow 73 enters the pump 16, the crescent 80 divides the liquid flow 73 and may also act as a seal between the inlet port 68 (i.e., suction port) and the outlet port 74 (i.e., discharge port). Eventually all of the voids in the pump 16 become flooded with liquid. Continued rotation of gears 60 and 62 then results in an intermeshing of the gears' teeth, forcing the liquid between the voids to exit through the outlet port 74 (e.g., as the flow 75). Indeed, the gear pump 16 enables a non-pulsatile or continuous movement of fluid while using only two moving parts (i.e., gears 60 and 62). Additionally, the gear pump 16 exhibits improved noise reduction because of the reduced number of moving parts, while increasing the suction force or lift when compared to other pumps, such as screw pumps.

In one embodiment, the integral passage 76 may be disposed in a metal cylinder 84 of the pump 16 and used to direct some of the lubrication flow 73 into the integral passage 76. As mentioned above with respect to FIG. 4, the integral passage 76 may direct the lubrication fluid into the wall 70 of the bearing system 18 and/or into the integral modular lubrication system 20. In this embodiment, additional rotation of the gears 60 and 62 self-lubricates the bearing system 18. That is, the rotation of the gears 60 and 62 directs additional lubrication fluid into the wall 70 of the bearing system 18 through the integral passage 76 and then to the integral passage 78 (shown in FIG. 4). Indeed, continuous operation of the gear pump 18 results in a continuous lubrication of the bearing system 18 without the need to add other systems such as computer-based controllers. Further, the bearing oil feed system 14 may support a turbomachinery component, such as the gear 56. Additionally the bearing oil feed system 14 may provide for suitable lubrication of other turbomachinery components. The use of gear pumps and the embedding of the bearing oil feed system 14 into the gear 56 substantially reduces the axial protrusion of the bearing oil feed system 14. This reduced axial profile enables certain turbomachinery 10, such as the compressor 50, to include larger scroll sizes with a corresponding improvement in compression efficiencies.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a rotor coupled to a bearing;

a gear pump directly coupled to the bearing via one or more threaded fasteners, wherein the gear pump is configured to route a lubricant to the bearing; and a first shaft drivingly coupled to the rotor and the gear pump, wherein the first shaft, the rotor, and the bearing axially overlap with one another.

2. The system of claim 1, wherein the rotor comprises a second shaft directly coupled to the first shaft of the gear pump.

3. The system of claim 1, wherein the rotor comprises a gear, wherein the gear pump is recessed axially within a bore of the gear, the bearing is disposed within the bore of the gear, and the first shaft extends axially through the bearing.

4. The system of claim 1, wherein a housing of the gear pump is directly coupled to a wall of the bearing via the one or more fasteners, the wall covers an opening into a cavity of the housing, and one or more gears of the gear pump are disposed inside of the cavity.

5. The system of claim 4, wherein the housing and the wall are stationary relative to the rotor.

6. The system of claim 1, wherein the gear pump comprises a crescent gear pump, a spur gear pump, a helical gear pump, or a gerotor pump.

7. The system of claim 1, wherein the rotor comprises integral passages directly coupled to the gear pump.

8. The system of claim 1, comprising a compressor, wherein the rotor is disposed in the compressor.

9. The system of claim 8, wherein the compressor comprises an integral modular lubrication system, and the integral lubrication system is configured to control one or more parameters of the lubricant.

10. The system of claim 8, wherein the integral modular lubrication system, comprises a filter, a heat exchanger, a thermal regulator, a valve, or a combination thereof.

11. A system comprising:

a bearing lubricant feed system configured to couple directly to a rotor, wherein the bearing lubricant feed system comprises:

a housing having an opening into a cavity;

a gear pump integrated with the housing inside the cavity;

a bearing having a wall coupled to the housing over the opening via one or more threaded fasteners, wherein the bearing is configured to enable a rotation of the rotor;

a shaft extending axially through the bearing, wherein the shaft is coupled to the gear pump, the shaft is configured to couple to the rotor, and the bearing is configured to mount within a bore of the rotor between the shaft and the rotor; and a lubricant feed passage integrated with the housing, wherein the lubricant feed passage extends to the bearing, and the lubricant feed passage is configured to deliver a lubricant to the bearing.

12. The system of claim 11, comprising an integral modular lubrication system, wherein the integral modular lubrication system is fluidly coupled to the bearing lubricant feed system through a conduit configured to deliver the lubricant.

13. The system of claim 12, wherein the conduit comprises an internal passageway between the bearing lubricant feed system and the integral modular lubrication system.

14. The system of claim 12, wherein the conduit comprises an external passageway between the bearing lubricant feed system and the integral modular lubrication system.

15. The system of claim 12, comprising a compressor integrated with the integral modular lubrication system, wherein the integral modular lubrication system is configured to deliver the lubricant to the compressor.

16. The system of claim 12, wherein the integral modular lubrication system comprises a filter, a heat exchanger, a thermal regulator, and a valve.

17. The system of claim 11, wherein the gear pump comprises a crescent gear pump, a spur gear pump, a helical gear pump, or a gerotor pump.

18. A system comprising:

a bearing lubricant feed system configured to mount into a recess of a rotor, wherein the bearing lubricant feed system comprises:

a housing having an opening into a cavity;

a gear pump integrated with the housing inside the cavity;

a bearing having a wall coupled to the housing over the opening via one or more threaded fasteners, wherein the bearing is configured to enable a rotation of the rotor;

a shaft extending axially through the bearing, wherein the shaft is coupled to the gear pump, and the shaft is configured to couple to the rotor; and a lubricant feed passage having an inlet port and an outlet port, wherein the gear pump is configured to transfer a lubricant from the inlet port into the outlet port, wherein the bearing is configured to mount into the recess of the rotor, wherein the housing and the wall of the bearing remain stationary, wherein the bearing lubricant feed system is configured to supply the lubricant to the bearing in the recess of the rotor.

19. The system of claim 18, comprising an integral modular lubrication system configured to process the lubricant, wherein the integral modular lubrication system is fluidly coupled to the outlet port or the inlet port.

20. The system of claim 18, wherein the gear pump comprises a crescent gear pump having a crescent and a first and a second gear, and the first and second gears rotate while the crescent remains stationary.

21. The system of claim 1, wherein the gear pump is directly coupled to the bearing along axially abutting surfaces, and the bearing closes an opening into a chamber of the gear pump.

22. The system of claim 1, wherein a housing of the gear pump comprises a chamber having a first gear and a second gear, wherein the housing is configured to route the lubricant from the chamber, through an internal passage separate from the first and second gears, and to the bearing.

23. The system of claim 1, wherein the bearing is recessed into a central bore along an axis of the rotor, and the gear pump is recessed into the bearing.

24. A system, comprising:

a gear pump, comprising:

a housing having a chamber;

a first pump gear disposed in the chamber;

a shaft drivingly coupled to the first pump gear;

a bearing coupled to the housing;

a lubricant passage configured to route a lubricant to the bearing; and a rotor mounting interface, wherein the rotor mounting interface comprises a shaft interface configured to drivingly couple the shaft to a rotor and a bearing interface configured to interface the bearing with the rotor, wherein the shaft, the bearing, and the bearing interface axially overlap with one another.

25. The system of claim 24, wherein the rotor comprises a gear, the bearing is recessed into a bore in the gear, and the shaft extends axially through the gear and the bore.

26. The system of claim 24, comprising a compressor having the rotor and the gear pump.

27. The system of claim 24, wherein the bearing is a wall portion of the housing.

28. The system of claim 24, wherein the bearing comprises a sleeve bearing portion extending axially from an end cover portion, and the end cover portion extends across an opening into the chamber.

29. The system of claim 24, wherein the gear pump comprises a crescent gear pump having a crescent, the first pump gear, and a second pump gear, wherein the first and second pump gears are configured to rotate while the crescent remains stationary.

30. The system of claim 24, wherein the housing, the first pump gear, the shaft, the bearing, the lubricant passage, and the rotor mounting interface are assembled together into a single unit forming the gear pump.

* * * * *